United States Patent [19]

Postma et al.

[11] Patent Number: 4,728,867

[45] Date of Patent: Mar. 1, 1988

[54] ELECTRODELESS LOW-PRESSURE DISCHARGE LAMP

[75] Inventors: Pieter Postma; Andreas C. Van Veghel, both of Eindhoven, Netherlands

[73] Assignee: U.S Philips Corporation, New York, N.Y.

[21] Appl. No.: 838,222

[22] Filed: Mar. 10, 1986

[30] Foreign Application Priority Data

Mar. 14, 1985 [NL] Netherlands ..... 8500738

[51] Int. Cl.[4] ..... H05B 41/16; H05B 41/24

[52] U.S. Cl. ..... 315/248; 313/493; 315/57; 336/175

[58] Field of Search ..... 315/248, 57, 75, 344; 313/493; 336/175, 176

[56] References Cited

U.S. PATENT DOCUMENTS 3,521,120 7/1970 Anderson ..... 315/57

3,924,223 12/1975 Whyte et al. ..... 336/175

FOREIGN PATENT DOCUMENTS 0137577 12/1978 Japan ..... 315/248

*Primary Examiner*—Saxfield Chatmon

*Attorney, Agent, or Firm*—Emmanuel J. Lobato

[57] ABSTRACT

An electrodeless low-pressure discharge lamp comprising a glass lamp vessel (1) which is sealed in a gas-tight manner and is filled with a metal vapor and a rare gas, this lamp vessel being provided with a tubular protuberance (2) which accommodates a rod-shaped core (3) of magnetic material surrounded by a wire winding (4) connected to a high-frequency supply unit, by means of which during operation of the lamp an electrical discharge is maintained in the lamp vessel, the inner side of the lamp vessel being provided with a transparent conductive layer (10), which is electrically connected by means of a lead-through member (12) to a conductor, such as a metal rod (11) provided in the core (3), located outside the lamp vessel, this lead-through member (12) being located at the end of the tubular protuberance, and being electrically connected to the internal conductive layer, for example by means of a wire spring (15).

6 Claims, 3 Drawing Figures

ELECTRODELESS LOW-PRESSURE DISCHARGE LAMP

Figure 1:
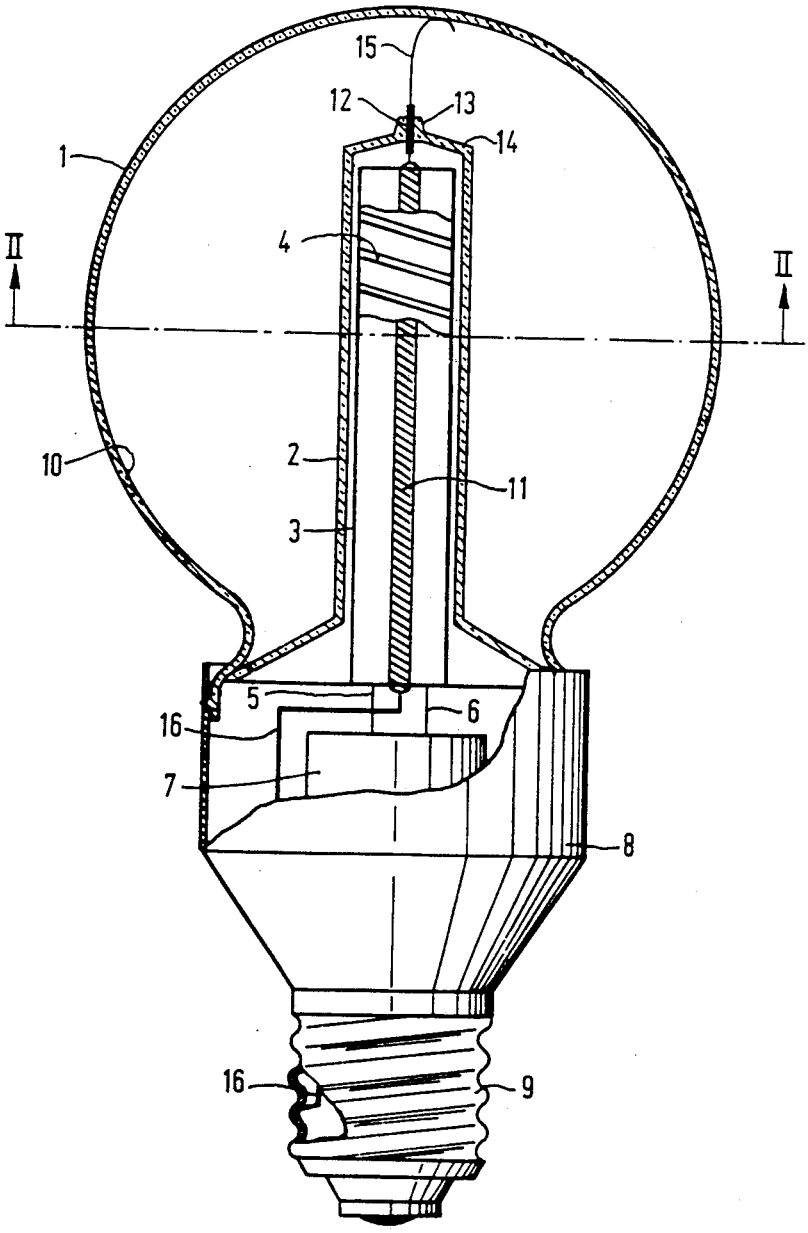

The invention relates to an electrodeless low-pressure discharge lamp comprising a glass lamp vessel which is sealed in a gas-tight manner and is filled with a metal vapour and a rare gas, the wall of the lamp vessel being provided with a tubular protuberance which accommodates a rod-shaped core of magnetic material surrounded by a wire winding connected to a high-frequency supply unit, by means of which during operation of the lamp an electrical discharge is maintained in the lamp vessel, the inner wall surface of the lamp vessel being provided with a transparent conductive layer which is electrically connected by means of a lead-through member to a conductor located outside the lamp vessel. Such a lamp is known from Netherlands Patent Application No. 8205025 laid open to public inspection and corresponding U.S. Pat. No. 4,565,859.

In the known lamp, the transparent conductive layer is connected during operation of the lamp via a conductor connected to the lamp cap to one of the lead-in wires of the supply mains. By a suitable choice of the sheet resistance ($R_{\square}$) of the said layer (for example about 20Ω), the high-frequency interference at the supply mains is reduced to an acceptable value.

The lamp vessel of the known lamp is sealed in a gastight manner by means of sealing material (such as glass enamel) by a sealing member which is provided with the tubular protuberance for receiving the core of magnetic material. The lead-through member for the connection of the transparent conductive layer to the conductor located outside the lamp vessel consist of a metal plate which is bent into the shape of a U and is secured around an edge of the lamp vessel prior to sealing of the sealing member and consequently extends through the seal. The manufacture of this lamp is time-consuming and troublesome both due to the use of small separate parts and due to the use of the necessary glass enamel. Moreover, this is a risk that nevertheless leakage will occur in due course in the finished lamp in the lamp vessel at the area of the U-shaped lead-through member. Furthermore, special steps are required to make the lamp sufficiently safe to touch near the said lead-through member because the lead-through member is connected to the supply mains.

The invention has for its object to provide an electrodeless low-pressure discharge lamp, in which the connection between the transparent conductive layer on the inner side of the lamp vessel and a conductor located outside the lamp vessel can be established in a simple, reliable and quick manner.

According to the invention, this object is achieved in an electrodeless discharge lamp of the kind mentioned in the opening paragraph in that the lead-through member is located in the wall at the end of the tubular protuberance, the lead-through member being electrically connected to the internal conductive layer.

The lamp according to the invention can be manufactured in a simple manner. The use of small separate parts is avoided. Another greater advantage of the lamp is that the use of glass enamel is not necessary for sealing the lamp vessel in a gas-tight manner. The sealing member is sealed by a simple fusion process, which has a great favourable influence on the speed of the manufacturing process.

The lead-through member (consisting, for example, of a metal pin, wire or sleeve) at the end of the tubular protuberance further has the advantage that the lamp can be sufficiently safely touched. The lead-through member is in fact connected during operation of the lamp to one of the conductors of the supply mains. In an embodiment, the lead-through member is arranged in the pinch of a mount closing the tubular protuberance.

The electrical connection between the lead-through member and the conductive transparent layer is established, for example, by welding a metal wire both to the said member and to the layer, for example with the use of a laser beam. However, a connection is preferred, in which the lead-through member has secured to it a metal wire spring, whose end presses against the said conductive layer. An electrical connection is then established. Such a construction is very suitable to be used in a mass production process. First the sealing member with protuberance is provided with the lead-through member with wire spring, whereupon the lamp vessel (with transparent conductive layer) is sealed in a gas-tight manner by fusion with the sealing member.

In another preferred embodiment of the lamp according to the invention, the lead-through member has secured to it a number of metal resilient tongues, whose ends press against the internal conductive layer. In such a construction, the electrical connection with the conductive layer is established at several areas at a time. Thus, the reliability of the electrical connection is increased. The said tongues are in the shape of longitudinal strips and are formed, for example, from a thin-walled metal conical body, whose tip is connected to the lead-through member. Such a body can be manufactured in a simple manner.

In a particular embodiment of the lamp, in which a rod-shaped metal body is included in the magnetic core in order to dissipate the heat developed in the core (see Netherlands Patent Application No. 8104223 laid open to public inspection), the lead-through member is electrically connected to the said metal body, the magnetic core being provided with a recess extending throughout its length and inwardly as far as the metal body.

This embodiment has the advantage that the said rod-shaped metal body in the core serves not only to dissipate heat, but at the same time serves as an electrical conductor. The use of a separate conductor which is connected to the lead-through member and is arranged, for example, beside the core in the tubular protuberance, is then avoided. In order to prevent the impedance of the rod-shaped conducting body from reaching too high a value during operation of the lamp, the magnetic core is provided with the said axially extending recess.

Figure 2:
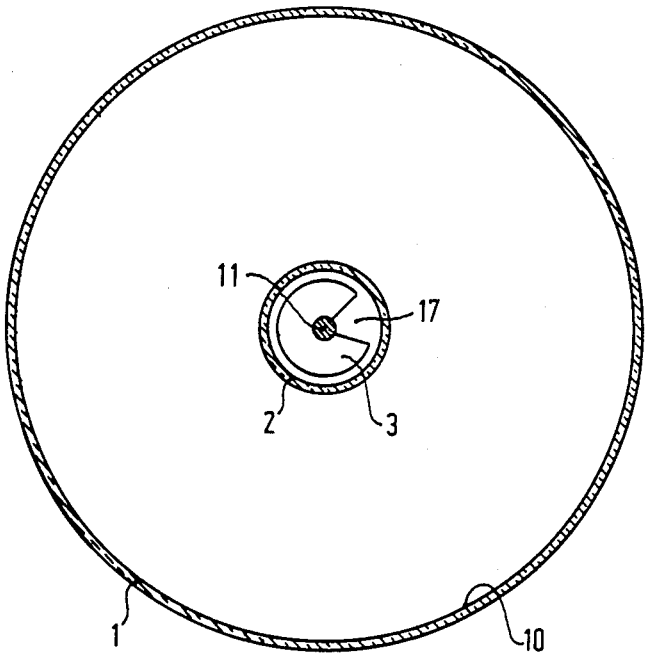
Figure 3:
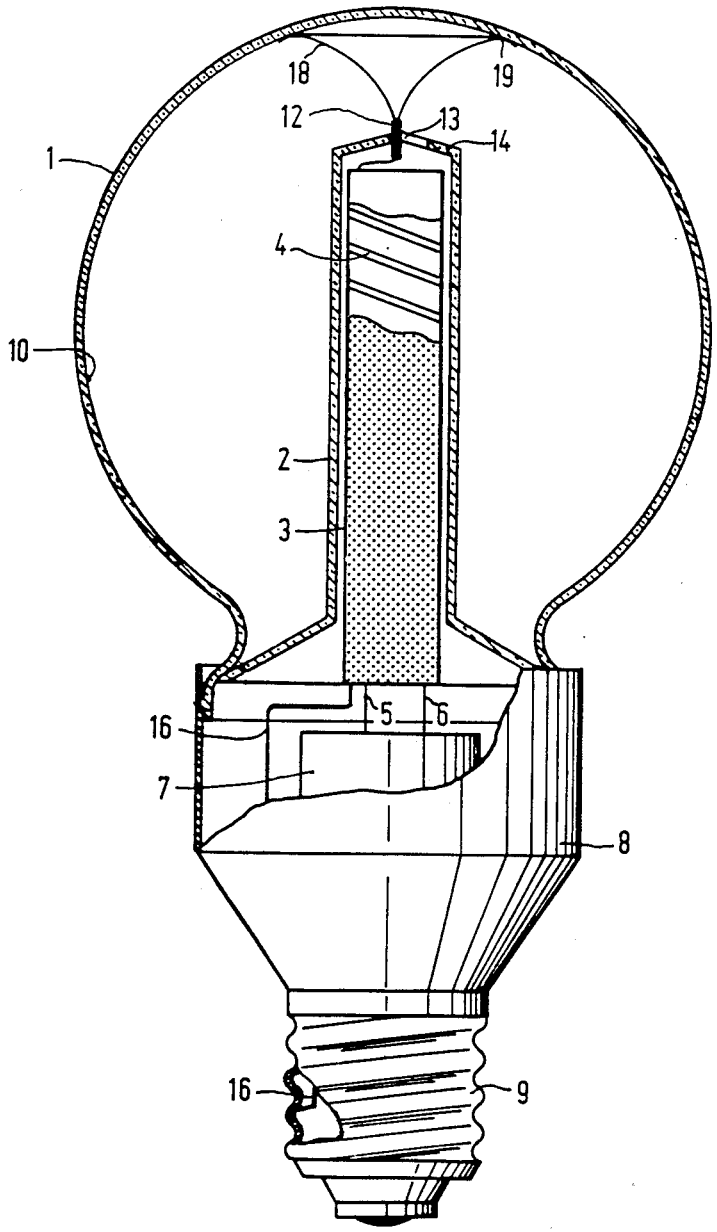

The invention will be described more fully with reference to the accompanying drawings which show two embodiments of the lamp according to the invention. In the drawings:

FIG. 1 shows diagrammatically, partly in side elevation and partly in sectional view, an electrodeless low-pressure mercury vapour discharge lamp according to the invention, FIG. 2 shows a cross-section of the lamp shown in FIG. 1 taken on the plane II—II, FIG. 3 shows also diagrammatically, partly in elevation and partly in sectional view, a second embodiment of an electrodeless low-pressure mercury vapour discharge lamp according to the invention.

The lamp shown in FIG. 1 comprises a glass lamp vessel 1 which is sealed in a gas-tight manner and is filled with a quantity of mercury and a rare gas, such as krypton (at a pressure of about 70 Pa). The wall of the lamp vessel is provided with a tubular protuberance 2, which accommodates a rod-shaped core 3 of magnetic material (ferrite). The core 3 is surrounded by a winding 4 consisting of a number of turns of copper wire, which is connected through wires 5, 6 to a high-frequency supply unit located in a metal housing 7. During operation of the lamp, a high-frequency magnetic field is produced in the core, while an electric field is produced in the lamp vessel. The housing 7 is surrounded by a space bounded by a wall portion 8 of synthetic material which is slightly conical at one side and is secured on the lower side of the lamp vessel. The said wall portion 8 is provided at its end with an Edison lamp cap 9.

The inner side of the lamp vessel is provided with a transparent conductive layer 10, which consists of fluorine-doped tin oxide. To this layer is applied a luminescent layer (not shown in the drawing). During operation of the lamp, the said internal conductive layer is connected to one of the lead-in wires of the supply mains in order to suppress interference currents at the conductors of the supply mains. Use is then made of a heat-conducting copper rod 11 which is present in the magnetic core 3 and is connected at one end to a metal pin-shaped lead-through member 12. This lead-through member 12 is located at the end of the tubular protuberance 2. It is accommodated in the pinch 13 of a mount 14, which is secured to the end of the tubular protuberance 2. The lead-through member is electrically connected to the inernal conductive layer 10 by a metal wire spring 15. The free resilient end of this spring 15 bears on the internal conductive layer 10. The other end of the rod 11 is connected via the wire 16 to the Edison cap 9, by means of which the connection with the supply mains is established, During the manufacture of the lamp, first the spherical part of the lamp vessel is provided with the conductive transparent layer, after which the luminescent layer is applied in known manner. Subsequently, the sealing member provided with the protuberance 2 with the lead-through member 12, the spring 15 and the core 3 with the rod 11 which is secured to the wall of protuberance 2 by a suitable glue is arranged and these parts are interconnected in a gas-tight manner by a simple fusion of the edges. During the securing step, the luminescent layer is locally removed by the free end of the spring and a sufficient contact with the internal conductive layer is formed.

The magnetic core 3 is provided throughout its length with a recess 17 extending inwardly of the core as far as the rod 11 in order to keep the impedance of the rod during operation as low as possible. This is illustrated in FIG. 2.

In the lamp shown in FIG. 3, parts corresponding to those of the lamp in FIG. 1 are designated by the same reference numerals. In the embodiment shown in FIG. 3 the central part of the magnet core 3 is not provided with a conductive copper rod. The lead-through member 12 is connected by a metal conductor 16 directly to the lamp cap 9. The lead-through member is provided with a number (for example eight) of resilient metal tongues 18, (two of which are visible in FIG. 3) whose ends 19 bear on the internal conductive layer. A reliable contact with the said layer is then possible. The tongues 18, consisting of chromium iron which is resistant to the effect of the discharge are in the shape of longitudinal strips and are secured to the leadthrough 12 by welding.

In a practical embodiment of the lamp shown in FIG. 1, the largest diameter of the bulb-shaped lamp vessel 1 is about 65 mm and the length of the lamp vessel is about 70 mm. The magnetic core (length 50 mm, diameter 8 mm) consists of a suitable ferrite (Philips 4C6). The supply unit in the metal housing 7 (which is likewise connected to the wire 16) comprises a high-frequency oscillator having a frequency of 2.65 MHz (see U.S. Pat. No. 4,415,838).

The transparent conductive layer 10 ($R_{\square}$ about 20Ω) of fluorine-doped tin oxide is applied by spraying a solution comprising tin chloride and a small quantity of ammonium fluoride in methanol. The luminescent layer applied thereto comprises a mixture of phosphors consisting of green luminescing terbium-activated cerium magnesium aluminate and red luminescing yttrium oxide activated by trivalent europium. It has been measured that with a power of 17 W supplied to the lamp (inclusive of feeding) the luminous flux was about 1200 lumen. The measured decrease of the interference current in the supply mains was ±50 dB (μV).

What is claimed is:

1. An electrodeless low-pressure discharge lamp comprising a glass lamp vessel which is sealed in a gas-tight manner and is filled with a metal vapour and a rare gas, this lamp vessel being provided with a tubular protuberance, which accommodates a rod-shaped core of magnetic material surrounded by a wire winding connected to a high-frequency supply unit, by means of which during operation of the lamp an electrical discharge is maintained in the lamp vessel, the inner side of the lamp vessel being provided with a transparent conductive layer which is electrically connected by means of a lead-through member to a conductor located outside the lamp vessel, characterized in that the lead-through member is located in the wall at the end of the tubular protuberance, the lead-through member being electrically connected to the internal conductive layer.

2. An electrodeless discharge lamp as claimed in claim 1, characterized in that the lead-through member has secured to it a metal wire spring, whose free end bears on the transparent conductive layer.

3. An electrodeless discharge lamp as claimed in claim 1, characterized in that the lead-through member has secured to it a number of metal resilient tongues, whose ends press against the internal conductive layer.

4. An electrodeless discharge lamp as claimed in claim 1, in which the rod-shaped core of magnetic material accommodates a likewise rod-shaped metal body, characterized in that the metal body is electrically connected to the lead-through member, the core of magnetic material being provided throughout its length with a recess extending inwardly thereof as far as the metal body.

5. An electrodeless discharge lamp as claimed in claim 2 in which the rod-shaped core of magnetic material accommodates a likewise rod-shaped metal body, characterized in that the metal body is electrically connected to the lead-through member, the core of magnetic material being provided throughout its length with a recess extending inwardly thereof as far as the metal body.

6. An electrodeless discharge lamp as claimed in claim 3 in which the rod-shaped core of magnetic material accommodates a likewise rod-shaped metal body, characterized in that the metal body is electrically connected to the lead-through member, the core of magnetic material being provided throughout its length with a recess extending inwardly thereof as far as the metal body.

* * * * *

UNITED STATES PATENT AND TRADEMARK OFFICE

CERTIFICATE OF CORRECTION

PATENT NO. : 4,728,867

DATED : March 1, 1988

INVENTOR(S) : PIETER POSTMA ET AL

It is certified that error appears in the above-identified patent and that said Letters Patent is hereby corrected as shown below:

Col. 1, line 20, "4,565,859" should be --4,568,859--

Signed and Sealed this

Twenty-fifth Day of October, 1988

*Attest:*

DONALD J. QUIGG

*Attesting Officer*

*Commissioner of Patents and Trademarks*